US005884725A

United States Patent [19]

Reyland

[11] Patent Number: 5,884,725

[45] Date of Patent: Mar. 23, 1999

[54] SCAFFOLDING ASSEMBLY

[75] Inventor: Shane Trevor Reyland, Pimpama, Australia

[73] Assignee: Kookoala Pty Ltd, Toowoomba, Australia

[21] Appl. No.: 750,839

[22] PCT Filed: Jun. 23, 1995

[86] PCT No.: PCT/AU95/00374

§ 371 Date: Dec. 19, 1996

§ 102(e) Date: Dec. 19, 1996

[87] PCT Pub. No.: WO96/00336

PCT Pub. Date: Jan. 4, 1996

[30] Foreign Application Priority Data

Jun. 23, 1994 [AU] Australia ..... PM6442

[51] Int. Cl.[6] ..... E04G 1/20

[52] U.S. Cl. ..... 182/82; 182/113; 182/136

[58] Field of Search ..... 182/82, 136, 113, 182/119, 222, 229, 128, 146

[56] References Cited

U.S. PATENT DOCUMENTS

| | | | |
|---|---|---|---|
| 485,463 | 11/1892 | Gnnis . | |
| 557,501 | 3/1896 | Gnnis . | |
| 657,396 | 9/1900 | Curley . | |
| 902,949 | 11/1908 | Dibler | 182/146 |
| 1,270,906 | 7/1918 | Whitney . | |
| 3,437,296 | 4/1969 | Hinz | 182/229 |
| 3,908,793 | 9/1975 | Vaughn | 182/82 |
| 4,583,618 | 4/1986 | Zimmerman | 182/119 |
| 4,598,794 | 7/1986 | Anderson | 182/136 |
| 4,942,940 | 7/1990 | Boeshart | 182/82 |
| 5,307,899 | 5/1994 | Lubinsky | 182/82 |

FOREIGN PATENT DOCUMENTS

| | | | |
|---|---|---|---|
| 1112160 | 3/1953 | France | 182/222 |
| 404128470 | 4/1992 | Japan | 182/128 |
| 1675519 | 9/1991 | U.S.S.R. | 182/128 |
| 10121 | 6/1890 | United Kingdom | 182/82 |

*Primary Examiner*—Alvin Chin-Shue
*Attorney, Agent, or Firm*—Young & Thompson

[57] ABSTRACT

A scaffolding assembly comprising uprights and building engagement means extending from the uprights to a building a carriage mounted on each upright with platforms pivotally connected to adjacent carriages.

8 Claims, 6 Drawing Sheets

SCAFFOLDING ASSEMBLY

TECHNICAL FIELD OF THE INVENTION

THIS INVENTION relates to a scaffolding assembly and in particular, but not limited to a portable scaffolding assembly for use adjacent low-rise buildings including domestic and light industrial or commercial buildings.

BACKGROUND ART

Trestles carrying planks are commonly used to service domestic buildings by painters and bricklayers. The main disadvantage of these trestle and plank arrangements is that they make access to the upper portion of a building difficult and as they are free standing, are generally unsafe.

The present invention has as one object to alleviate at least to some degree the aforementioned problems associated with the prior art.

OUTLINE OF THE INVENTION

In one aspect therefore, the present invention resides in a portable scaffolding assembly comprising spaced uprights, upper building engagement means and a platform, the spaced uprights extending generally vertically and being spaced from a building or the like, each upright extending from the ground and having an upper building engagement means bridging between the building and the upright in predetermined spaced relationship relative to the building and the platform extending between the uprights.

In a preferred form there is provided a scaffolding assembly suitable for use on ground adjacent a low rise building of the type having a wall and roof structure supported by the wall, the scaffolding assembly comprising a plurality of uprights spaced along the wall structure and each upright being about the same distance from the wall structure, each upright having a lower end on the ground and an upper end adjacent the roof, building engagement means extending from the building to each upright to hold the upper ends of the uprights in fixed spaced relation to the building, adjacent uprights having respective carriages and means for independently raising or lowering the carriages incrementally in turn along the respective uprights, adjacent carriages pivotally supporting a platform therebetween and the platform extending from the uprights toward the wall structure.

Typically where it is desirable to carry out work on the roof of the building a safety fence extends about the upper ends of the uprights adjacent the roof.

The uprights can be any suitably rigid vertical members and typically lightweight hollow telescopic sections are employed. Typically, the upright sections are adjustably secured together to account for the various height differences from building to building or along the scaffolding assembly. Each upright is typically pivotally coupled to the building engagement means so that the building engagement means can be secured to the building at different angles relative to the uprights.

The building engagement means is typically a roof engaging means adapted to be coupled to a roof and bridge across to an upright. The building engagement means preferably allows limited vertical movement of the uprights relative to the building engagement means to account for site subsidence. In another form the building engagement means is a T-shaped wall mounting where the top of the T-shape extends along the wall.

The uprights and building engagement means are preferably releasably held together by catch means having a mouth adapted to receive an upright and automatically close in order to hold the upright, the catch having positive release means that must be actuated to release the upright.

The platform can be mounted to the uprights in any suitable fashion but is typically vertically adjustable. Typically, a cable and winch assembly is employed so that an operator can stand on the platform and winch the platform vertically up or down. The platform can extend horizontally, sideways either side of the uprights or can extend both sides of the uprights. The platform is preferably coupled to the uprights by a carriage travelling on each upright. The platform is preferably made from a plurality of planks that can be separated for transport purposes adjacent planks being held together by rails having back-to-back channels holding respective edges of adjacent planks.

Typically, moveable rods or other rigid bridging means is used to pass through adjacent platform sections at spaced intervals to hold the platform sections together. The platform is preferably pivotally coupled to the uprights at each end so that the platform can be selectively raised at each end. Advantageously, the platform is prestressed vertically using a prestressing means to limit downward vertical movement of the platform as a person walks on the platform. This inhibits bouncing. Preferably, safety rails are employed bridging between uprights, the safety rails being located adjacent the platform and being adapted to pivot in concert with ends of the platform. Typically, a workbench is employed adjacent the platform and being adapted to move with the platform and being provided for the purpose of mounting tools or the like.

The scaffolding assembly preferably includes a jib and winch assembly to elevate parts of the assembly while scaffolding is being erected. Typically, the jib is formed as part of or is attached to the building engagement means.

Where corners of the building are involved the scaffolding assembly is preferably equipped with a corner frame projecting from a carriage adjacent an upright located on one side of the corner and the corner frame being pivotally coupled to a platform extending around and on the other side of the corner so that the scaffolding assembly follows the corner.

BRIEF DESCRIPTION OF THE DRAWINGS

In order that the present invention can be more readily understood and be put into practical effect, reference will now be made to the accompanying drawings which illustrate preferred embodiments of the present invention and wherein.

Figure 1:
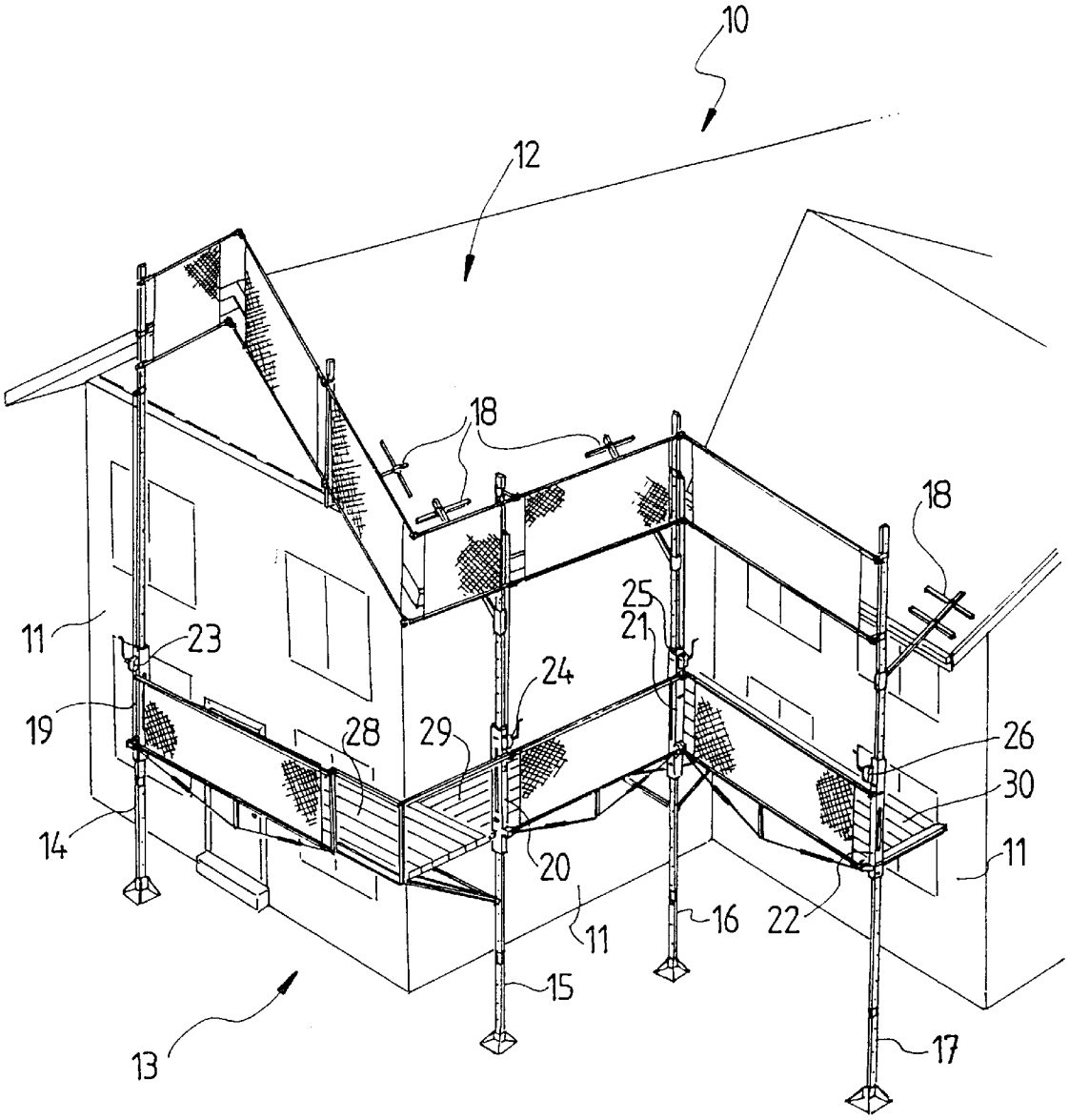
FIG. 1 is a perspective view illustrating a scaffolding assembly according to the present invention.

Referring to the drawings and initially to FIG. 1 there is illustrated a low rise building 10 having a wall structure 11 and a roof structure 12 supported by the wall 11. A scaffolding assembly 13 comprises, in this case, four uprights 14, 15, 16 and 17 spaced along the wall structure with each upright being about the same distance from the wall structure, each upright has a lower end on the ground and an upper end adjacent the roof 12.

Building engagement means in the form of roof mounting brackets 18 extend from the building to each upright to hold the upper ends of the uprights in fixed space relation to the building, adjacent uprights have respective carriages 19, 20, 21 and 22 and hand winches 23, 24, 25 and 26 respectively for independently raising or lowering the carriage incrementally in turn in order to raise and lower platforms 28, 29 and 30. To this end the platforms are pivotally supported and extend toward the wall structure so that service personnel can raise and lower the platforms to work on the wall structure.

In the illustrated embodiment of FIG. 1 a roof fence extends adjacent the eaves as shown and thereby provides a safety fence for service personnel working on the roof.

It will be appreciated that the scaffolding assembly is particularly suitable for use in low rise building and can be utilised in either new buildings where there is merely a wall framework and roof framework or in existing buildings.

Figure 2:
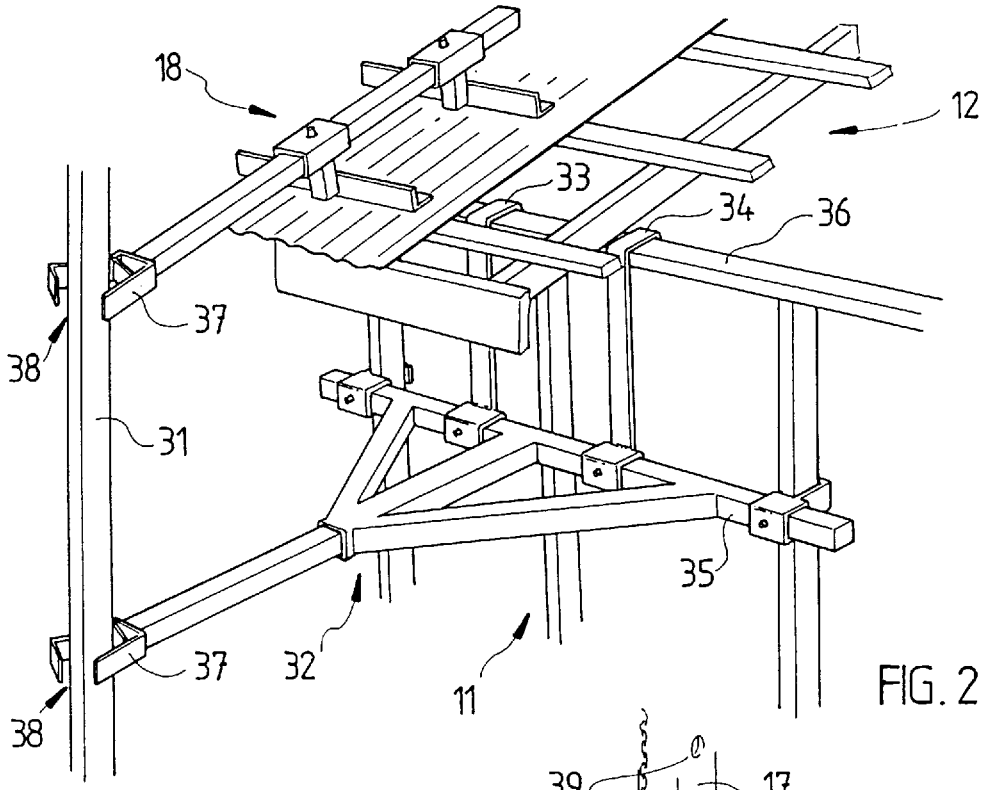
FIG. 2 is a perspective view illustrating a roof mounting means and in the same drawing for convenience there is also illustrated a typical wall mounting means both of which are suitable for use with the present invention.

Referring to FIG. 2 there is illustrated two typical building engagement means whereby an upright 31 is in the process of being coupled to a roof mounting 18 and also for convenience is shown in the process of being coupled to a wall mounting 32. The mountings 18 and 32 are telescopic mountings to aid set up and as can be seen the mounting 32 is generally T-shaped extending along the wall structure 11 and is equipped with a pair of hooks 33 and 34 secured to the beam 35 and hooking over the wall frame member 36. Clamps are employed to secure the beam 35 at its respective ends as shown.

Also in FIG. 2 is illustrated a quick release clamp 37 which includes a mouth 38 so that when the upright 31 is swung into place it passes through the mouth 38 and the clamp 37 automatically closes and locks upright 31 to the mountings 18 and 32.

Figure 3:
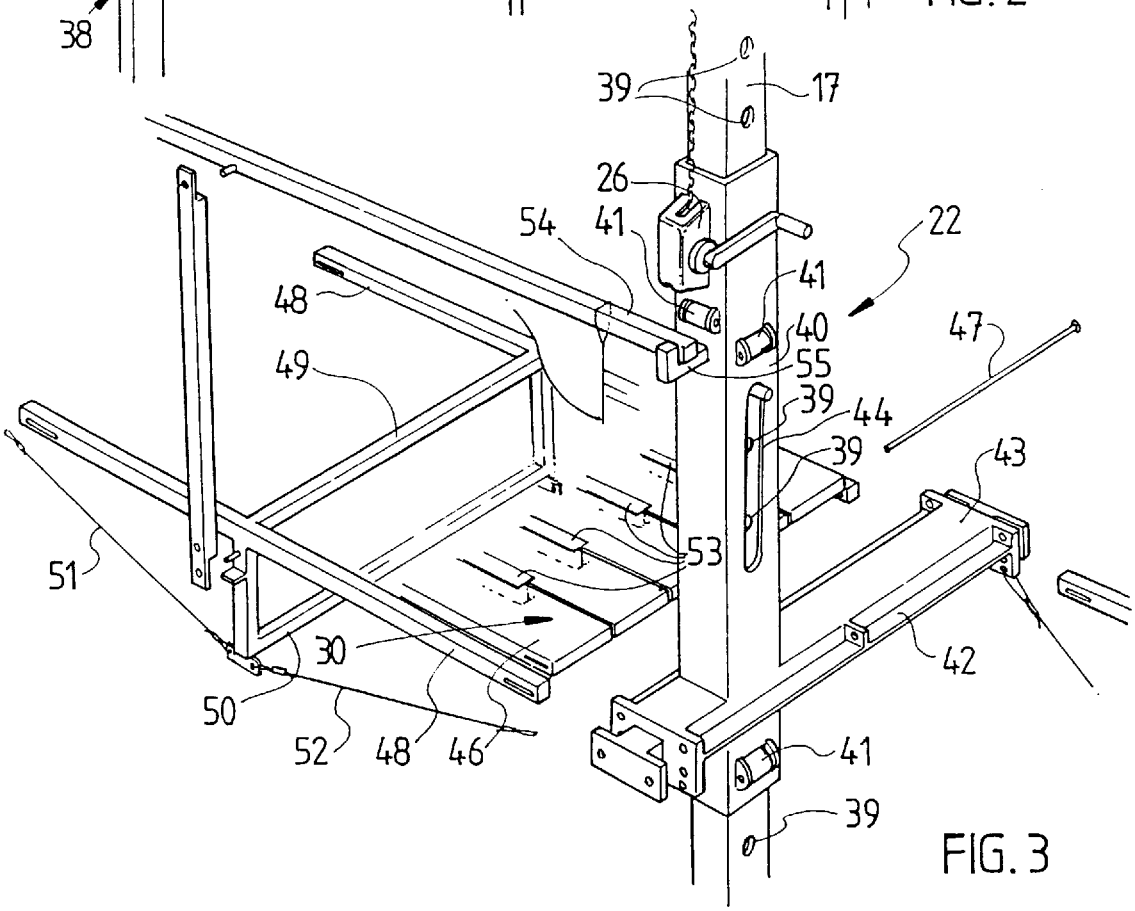
FIG. 3 is an exploded perspective view illustrating typical carriage and platform details.

Referring now to FIG. 3 there is illustrated in more detail a typical carriage 22 where the upright 17 is shown and is of square section having 300 mm spaced through holes 39 along its length the carriage including a tube section 40 mounted with rollers 41 and passing through a hat section 42 mounted over a cantilevered tube section 43 to provide a rigid platform support protecting from the tube 40. Tube 40 includes a slot 44 greater in length than the 300 mm spacing of the holes 39. A locking pin 45 is employed to slide through a selected one of the holes 39 and also engage with the slot 44 to lock the carriage 22 at a selected position.

As can be seen platforms and platform frame members are pivotally coupled to the carriage so that a carriage can be raised using the winch 26 and then the locking pin 45 is moved to the next highest hole so the carriage is locked into position. The operator then moves to the other end of the platform and raises the carriage on the next upright and thereby levels the platform. This incremental movement is carried out alternately in order to raise and lower the platform to any desired position.

As can be seen in FIG. 3 the platform 30 in this case has five planks 46 connected together with a pivot pin 47 which extends through the rails 48 of a platform support frame. The platform support frame includes cross members 49 and 50 which are braced using cables and turnbuckles as shown at 51 and 52 to thereby inhibit bouncing of the platform. The planks 46 are connected together and held against individual movement by removable I-beams shown generally at 53.

A hand rail 54 is pivotally coupled at each end to the respective carriages and is seared on a L-shaped mounting 55 so that the hand rail is effectively locked in place and cannot be inadvertently moved.

Braces arrange the same as braces 51 and 52 are utilised the other side of the platform support frame.

Figure 4:
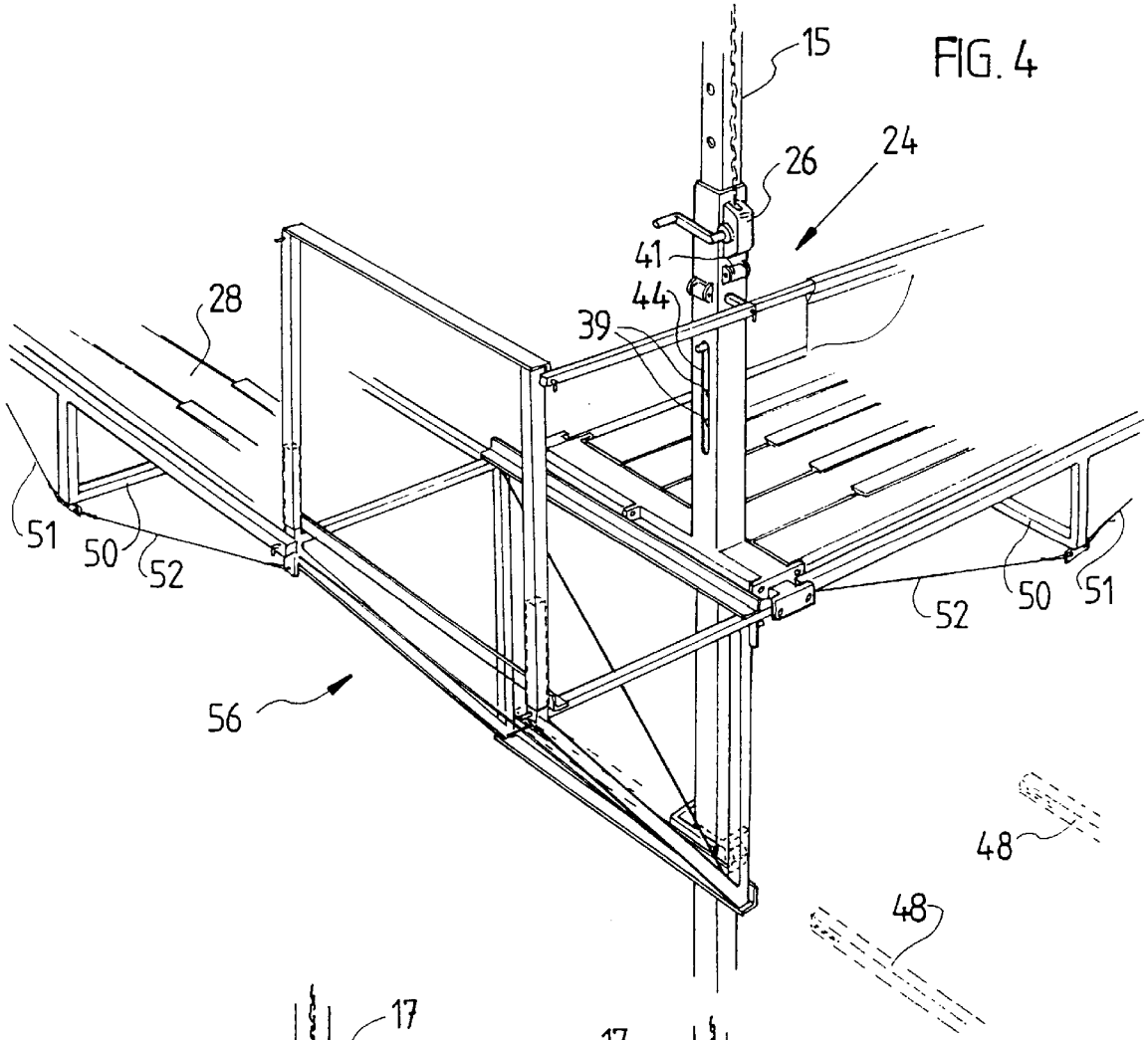
FIG. 4 is a perspective view illustrating a typical corner frame employed in a scaffolding assembly according to the present invention.

FIG. 4 illustrates the upright 15 which in all respects operates the same as the carriage and platform arrangement discussed above in relation to FIG. 3. In FIG. 4 a corner frame 56 is employed and this corner frame is rigidly coupled to the carriage 20 and thereby moves with the carriage 20. The corner frame is braced and includes a lower roller bracket. Illustrated in phantom are the positions of a frame platform member 48 and reversal of the lower roller for an internal corner. The planks 28 which are only partially shown in FIG. 4 extend over the corner frame and can if desired extend beyond the corner frame. Planks 28 are pivotally mounted to the corner frame at 57 as previously described. As the carriage 20 in this case it is raised or lowered through 300 mm at a time and the operator moves to the next carriages on the upright in this case the upright 74 he raises or lowers the carriage 19 accordingly. The corner frame 56 can have the roller bracket reversed and the rails removed so it can be used as an inside corner such as the inside corner illustrated in relation to carriage 21 in FIG. 1.

Figure 5:
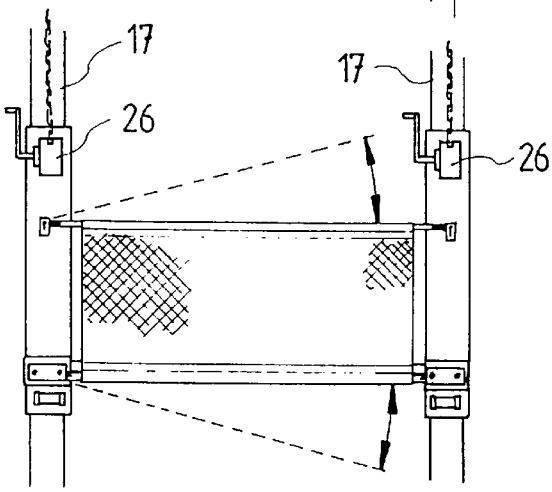
FIG. 5 is a schematic view illustrating the usual method employed for raising and lowering a platform.

FIG. 5 illustrates the incremental movement of respective carriages and it will be appreciated that the rails connecting the carriages and platform frames include slotted pivots to account for the parallelogram action resulting from the pivotal movement relative to the carriages.

Figure 6:
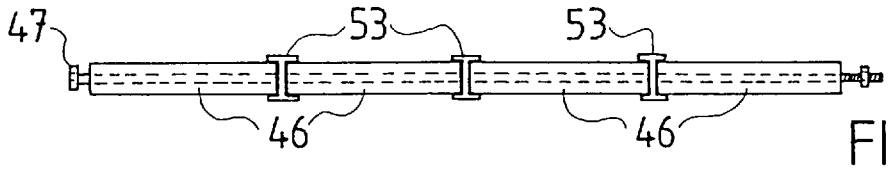
FIG. 6 is a section showing an assembled platform in profile.

Referring to FIG. 6 there is illustrated a typical platform showing the pivot pin also serving as a connector and the I-beams 53 used to prevent independent movement of the planks 46.

Figure 7:
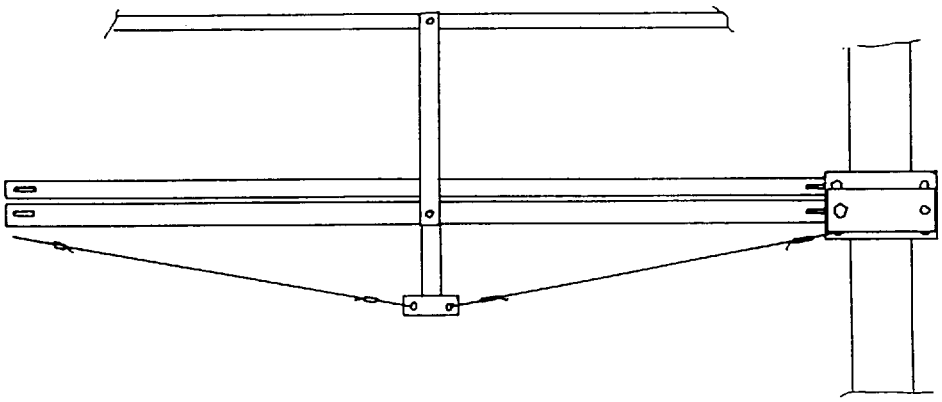
FIG. 7 is a side view showing a platform brace arrangement.

FIG. 7 illustrates the platform frame and bracing arrangement previously described.

Figure 8:
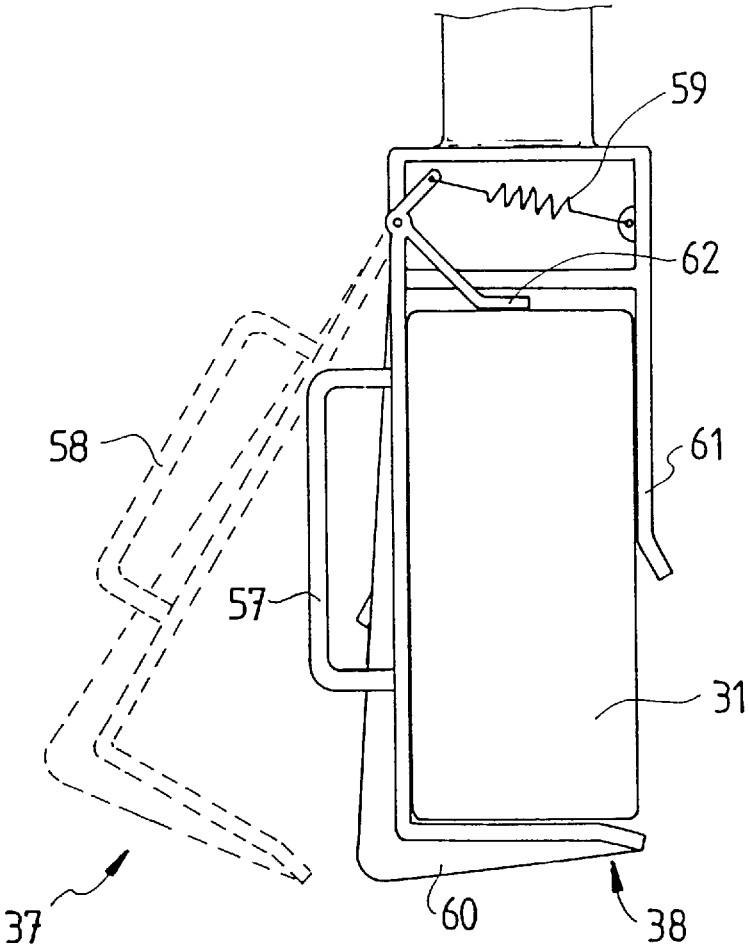
FIG. 8 is a plan view showing operation of a typical quick release clamp for connecting an upright to a building engagement means.

FIG. 8 illustrates in greater detail the quick release clamp 37 utilised with the uprights of FIG. 1 and the upright 31 of FIG. 2. As can be seen upright 31 is shown locked in place, handle 57 can be positively and manually moved to the position illustrated in phantom at 58 in order to release the upright 31. It will be appreciated that due to the use of a spring 59 when the upright 31 is not in place the handle 58 and the jaw 60 will be in the position illustrated in phantom. This provides a mouth between the moveable jaw 60 and the stationary jaw 61. A lever arm 62 is provided so that as the upright 31 moves through the mouth 38 and engages the lever arm 62 the jaw 60 automatically closes to the position shown in solid outline in FIG. 8, thereby locking upright 31 in place.

Figure 9A:
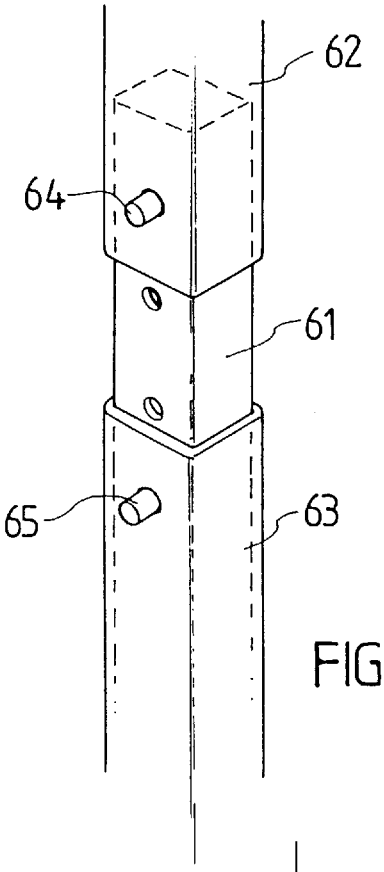
FIG. 9A is a part view illustrating a connection between sections of an upright.
Figure 9B:
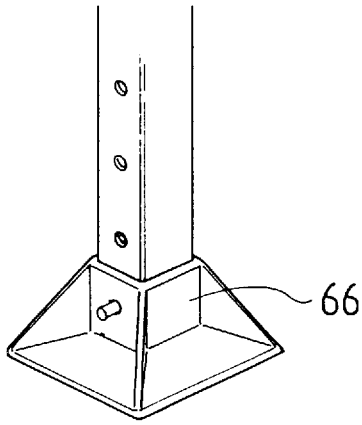
FIG. 9B is an upright foot detail.

FIGS. 9A and 9B are details of preferred uprights used with a scaffolding assembly as described previously. The uprights are usually made from a number of sections and FIG. 9A illustrates a typical means for connecting sections of uprights together and in this case a connecting rail 61 is slidably disposed and telescopically positioned within respective upright sections 62 and 63 and pins 64 and 65 can be used to secure the sections together. FIG. 9B illustrates a removable foot 66 suitable for use at the bottom of an upright and engaging the ground.

Figure 10:
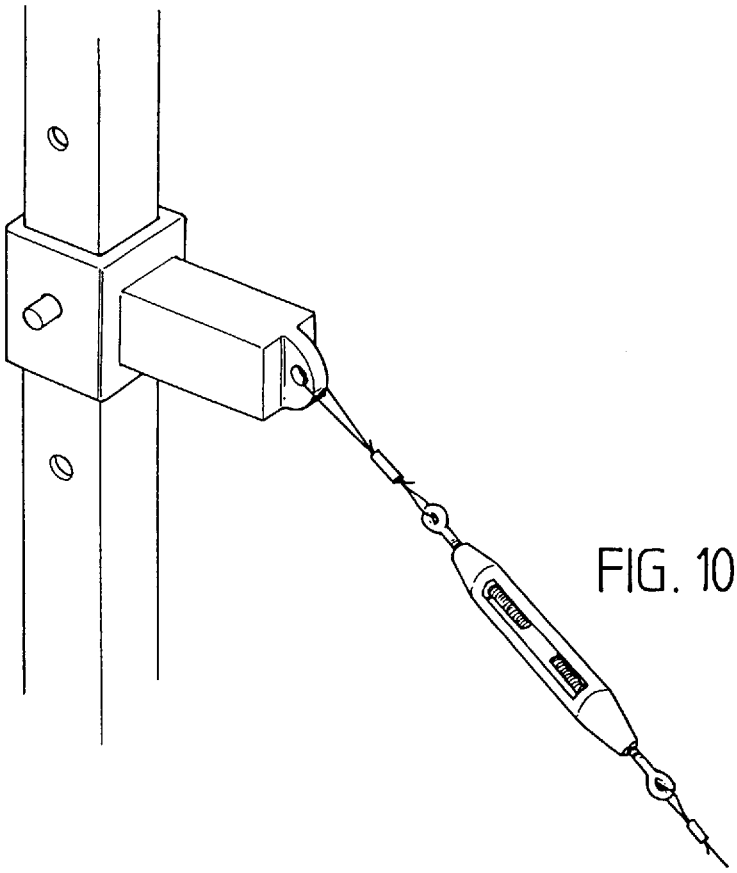
FIGS. 10, 11A, 11B and 12 are various brackets allowing various connections to uprights.
Figure 11A:
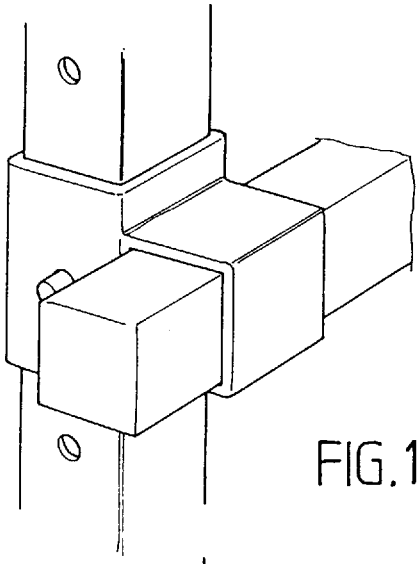
Figure 11B:
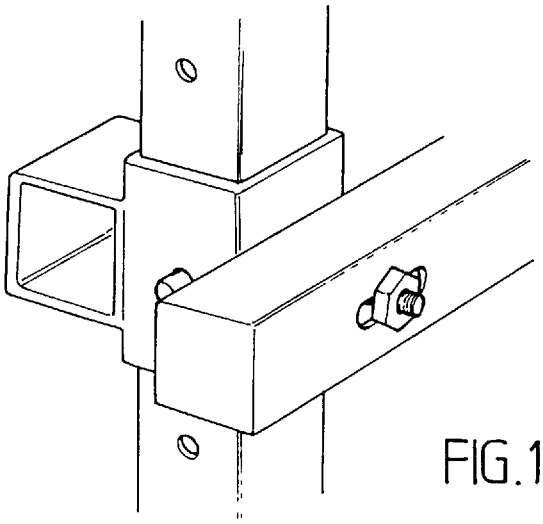
Figure 12:
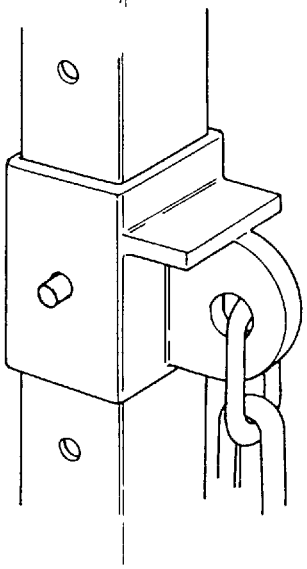

FIGS. 10 through 12 illustrate various brackets which can be slid along uprights and locked in the holes 39 using locking pins.

Figure 13:
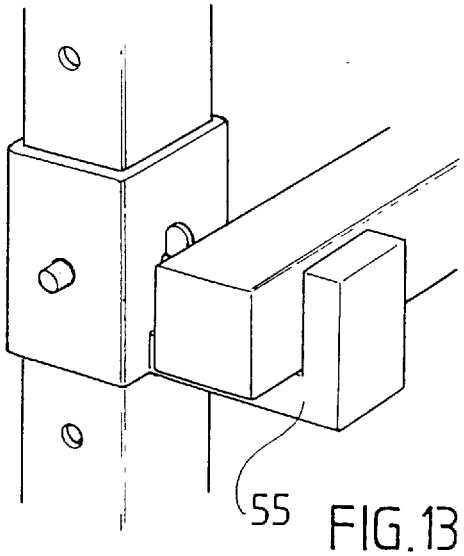
FIG. 13 is a perspective view of a hand rail connection to an upright connector.
Figure 14A:
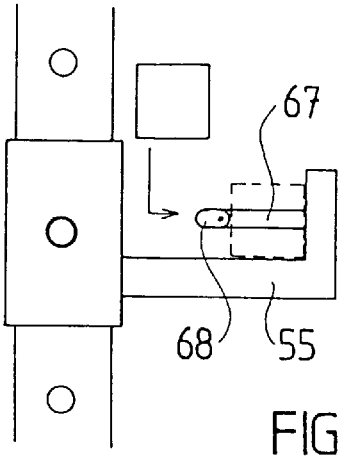
FIGS. 14A and 14B illustrate connection of hand rail to a carriage.
Figure 14B:
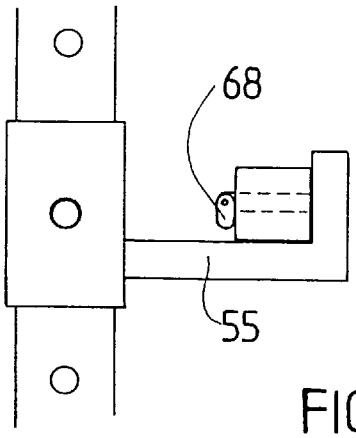

FIGS. 13, 13A and 14B illustrate a typical hand rail connection where a bracket similar to the connection 55 of FIG. 2 includes a pin 67, a pivoting toggle 68 used the lock the hand rail in place. This process is shown in FIGS. 14A and 14B.

Whilst the above has been given by way of illustrative example of the present invention, many variations and modifications thereto will be apparent to those skilled in the art without departing from the broad ambit and scope of the invention as set forth in the appended claims.

I claim:

1. In a scaffolding assembly for use on ground adjacent a low rise building of the type having a wall structure and a roof structure supported by the wall structure, the scaffolding assembly comprising a plurality of uprights adapted to be spaced along a wall structure at about the same distance from a wall structure, each upright having a lower end which in use is positioned on the ground and an upper end adapted to be positioned adjacent a roof structure, building engagement means extending from each upright and adapted to hold the upper ends of the uprights in fixedly spaced relation to a building, adjacent uprights having respective carriages thereon and means for independently raising and lowering the carriages along the uprights, adjacent carriages supporting a platform therebetween; the improvement wherein each end of the platform has a pivotal connection means thereon and each carriage has a complementary pivotal connection means for connection to the pivotal connection means at an adjacent end of the platform, whereby the platform is pivotably connected and supported between adjacent carriages, the platform extending from said uprights in the same direction as said building engagement means.

2. A scaffolding assembly according to claim 1, wherein said assembly includes a fence extending about the upper ends of the uprights and adapted to be positioned adjacent a roof structure to provide a safety fence for workers working on a roof structure.

3. A scaffolding assembly according to claim 1, wherein each building engagement means comprises a roof structure mounting adapted to be secured to a roof structure and connected to the upright at an inclined angle thereto.

4. A scaffolding assembly according to claim 1, wherein the building engagement means comprises a generally T-shaped wall structure mounting means with the top of T-shape adapted to extend along and be fixed to a wall structure.

5. A scaffolding assembly according to claim 1 wherein the platform comprises a plurality of planks that can be separated for transport purposes, plank connector means being provided for holding the planks together so that the planks act as a single unit.

6. A scaffolding assembly according to claim 5 wherein the connector means comprises an elongate rail having back-to-back channels, respective channels receiving and holding respective edges of adjacent planks.

7. A scaffolding assembly according to claim 1 wherein the platform extends around a corner, the corner including a corner frame projecting from and rigidly secured to a carriage and being pivotally coupled to a platform extending from around and on the other side of the corner.

8. A scaffolding assembly according to claim 1 wherein the building engagement means and the uprights are secured together using a catch means having a mouth adapted to receive an upper end of the upright and automatically closed to hold the upright, the catch means having positive release means that must be actuated to release the upright.

* * * * *